United States Patent [19]

Hanson

[11] 4,358,249

[45] Nov. 9, 1982

[54] VACUUM CHAMBER WITH A SUPERSONIC FLOW AERODYNAMIC WINDOW

[75] Inventor: Clark L. Hanson, Livermore, Calif.

[73] Assignee: The United States of America as represented by the United States Department of Energy, Washington, D.C.

[21] Appl. No.: 196,998

[22] Filed: Oct. 14, 1980

[51] Int. Cl.[3] ..... F04F 5/00

[52] U.S. Cl. ..... 417/179; 328/233

[58] Field of Search ..... 328/233; 313/231.31, 313/231.41; 417/151, 179, 180, 251, 65, 173, 152–154

[56] References Cited

U.S. PATENT DOCUMENTS 3,546,524 12/1970 Stark ..... 328/233 X

OTHER PUBLICATIONS

"Dynamic Pressure Stages for High Pressure/High Vacuum Systems" by B. W. Schumacher, Ontario Research Foundation, Physics Research Report 5806 (1958).

"Supersonic Flow Aerodynamic Windows for High Power Lasers" by E. M. Parmentier et al., Paper 72–710 of the AIAA 6th Fluid and Plasma Physics Conf., Boston, Mass. Jun. 26–28, 1972.

"Steam Ejectors" by B. D. Powers, *High Vacuum Pumping Equipment,* Chapman and Hall, Ltd., 1966, Chapter 4.

"Steam Ejector–Condenser–Stage 1 of a Differential Vacuum Pumping Station" by C. L. Hanson et al., Journ. of Vac. Sci. Technol., Apr. 1981, pp. 1164–1168.

*Primary Examiner*—William L. Freeh
*Assistant Examiner*—Edward Look

[57] ABSTRACT

A supersonic flow aerodynamic window, whereby a steam ejector situated in a primary chamber at vacuum exhausts superheated steam toward an orifice to a region of higher pressure, creating a barrier to the gas in the region of higher pressure which attempts to enter through the orifice. In a mixing chamber outside and in fluid communication with the primary chamber, superheated steam and gas are combined into a mixture which then enters the primary chamber through the orifice. At the point of impact of the ejector/superheated steam and the incoming gas/superheated steam mixture, a barrier is created to the gas attempting to enter the ejector chamber. This barrier, coupled with suitable vacuum pumping means and cooling means, serves to keep the steam ejector and primary chamber at a negative pressure, even though the primary chamber has an orifice to a region of higher pressure.

10 Claims, 4 Drawing Figures

VACUUM CHAMBER WITH A SUPERSONIC FLOW AERODYNAMIC WINDOW

The U.S. Government has rights in this invention pursuant to Contract W-7405-ENG-48, between the U.S. Department of Energy and the University of California.

BACKGROUND OF THE INVENTION

The present invention relates generally to the creation and maintenance of a vacuum in a chamber which is open to the atmosphere. This invention relates more particularly to supersonic steam aerodynamic windows.

For certain purposes, it is desired to fire corpuscular beams into gases of high pressure, as for example in electron beam welding. In such instances, the beams are formed in a high vacuum space, and possess either kinetic energies too low for the penetration of a thin foil solid window, or current density so high as to melt any such window. With a supersonic flow aerodynamic window, the pressure difference between the high vacuum space and the area of high pressure is supported by centrifugal forces induced by the curvature of a supersonic gas jet. Since the flow is supersonic, turning of the jet occurs across waves, and window designs using both expansion and compression waves have been considered. The flow rate required by these windows is an important measure of their efficiency, and depends on the window design and operating conditions. A more detailed description of supersonic flow aerodynamic windows can be found in the paper, "Dynamic Pressure Stages for High-Pressure/High-Vacuum Systems," by B. W. Schumacher, Ontario Research Foundation, Physics Research Report 5806 (1958), incorporated herein by reference.

As has been practiced in the art, a supersonic flow aerodynamic window operates by expanding a high pressure gas to supersonic speeds in a two-dimensional converging/diverging nozzle. It is known in the art to direct air or some other dry gas through a nozzle at an angle across the path of high pressure air entering through an orifice into a vacuum chamber. The dry supersonic air passing across the opening sets up a shock wave which functions as a barrier to stop the inflow of high pressure air. A disadvantage of this arrangement is that large compression or pumping systems are required in order to keep the vacuum chamber at a low enough pressure suitable for the application intended. Additionally, only openings on the order of 10 mm in width are permitted if the vacuum pumps are to maintain the pressure ratio desired between the high pressure region and the low pressure region. Paper 72-710 of the AIAA 6th Fluid and Plasma Physics Conference, Boston, Mass., June 26–28, 1972, entitled, "Supersonic Flow Aerodynamic Windows for High-Power Lasers," by E. M. Parmentier and R. A. Greenberg, incorporated herein by reference, more thoroughly discusses the use of supersonic jets to support a pressure difference between two cavities open to each other through an orifice.

A steam ejector typically operates by accelerating superheated steam under pressure through a convergent-divergent nozzle to emerge with a velocity which may exceed 3,000–4,000 feet/second. Air or gas in the vicinity of the point where the steam leaves the nozzle becomes entrained with the steam, and this entrainment creates a vacuum as the air or gas is pulled along with the steam. The vapor jet loses some of its velocity in sharing momentum with the air or gas which has been entrained, and the gas-vapor mixture thereafter decelerates progressively as the mixture travels along the ejector tube, losing kinetic energy and gaining pressure energy until, at the ejector outlet, the desired degree of compression has been achieved. The ejector tube is contoured to provide the appropriate flow area at every stage of the deceleration and compression, deceleration at supersonic speeds requiring a converging, and at subsonic speeds a diverging, passage. Steam ejectors are more completely described in *High Vacuum Pumping Equipment*, by B. D. Powers, Chapter 4, "Steam Ejectors" (1966), which is incorporated herein by reference.

It is a unique feature of this invention to use a steam ejector in place of a standard nozzle supplying dry gas across the aperture between the high and low pressure areas. Additionally, it is unique to mix superheated steam with the air in the high pressure area prior to admitting it through the aperture into the low pressure area. The combination of using the steam ejector as well as mixing superheated steam with the incoming atmospheric air provides much more efficient pumping action to keep the low pressure chamber in a vacuum state, and also permits use of a much larger aperture.

It is, accordingly, a general object of the invention to provide an improved apparatus and method for maintaining a vacuum in a chamber which has an opening to the atmosphere wherein an aerodynamic window using steam creates a barrier to limit the entry of atmospheric air passing through the opening.

It is another object to provide an improved apparatus and method for maintaining a vacuum in a chamber which is open through an orifice to atmospheric air, wherein an aerodynamic window using superheated stream creates a barrier to the opening whereby the apparatus can be used with a linear accelerator as the first stage of a differential vacuum pumping system for accommodating the passage of an accelerated electron beam into the atmosphere.

It is a further object to provide an improved apparatus and method for maintaining a vacuum in a chamber which has an opening to the atmosphere, wherein an aerodynamic window is created by colliding a jet of superheated steam and a jet of air/superheated steam mixture within the chamber to form a barrier, limiting communication of the atmosphere with the chamber; and further including a cooling system to condense the steam and remove the condensate from the chamber, thereby enhancing the vacuum condition of the chamber.

Additional objects, advantages, and novel features of the invention will be set forth in part in the description which follows; and in part will become apparent to those skilled in the art upon examination of the following; or may be learned by practice of the invention. The objects and advantages of the invention may be realized and attained by means of the instrumentalities and combinations particularly pointed out in the appended claims.

SUMMARY OF THE INVENTION

To achieve the foregoing and other objects, and in accordance with the purpose of the present invention as embodied and broadly described herein, a method and apparatus are provided for maintaining a vacuum in a chamber which has an opening to the atmosphere, by use a steam to create an aerodynamic window. A stream of superheated steam is ejected through nozzle means into the chamber, to collide with a second stream comprising a mixture of atmospheric air and superheated steam.

Outside the primary chamber is a mixing chamber where atmospheric air is mixed with the superheated steam. The mixing chamber empties into the primary chamber through the orifice, whereby the mixture passes through the orifice to collide with the superheated steam exiting the ejector. At this point of collision, a barrier is formed which restricts the entry of atmospheric air into the chamber.

A cooling system utilizing a water spray system and a water coolant circulating system are included to condense the steam and enhance the vacuum state of the chamber. A drain for the chamber is provided to effect removal of the condensate. By using vacuum pumps attached to the primary chamber by suitable piping, and by the effect of using a steam condensation system in conjunction with the supersonic aerodynamic window, it is possible to maintain the primary chamber at a constant vacuum, even though it includes an opening to the atmosphere.

The supersonic flow aerodynamic window disclosed herein permits a large opening to the atmosphere, while at the same time maintaining a high vacuum in the ejector and primary chamber. Both the relatively large opening and the high vacuum are much greater than can be attained with currently known supersonic flow aerodynamic windows.

BRIEF DESCRIPTION OF THE DRAWINGS

The accompanying drawings, which are incorporated in and form a part of the specification, illustrate an embodiment and an example application of the present invention; and, together with the Description, serve to explain the principles of the invention. In the drawings.

DETAILED DESCRIPTION OF THE PREFERRED EMBODIMENT

Figure 1:
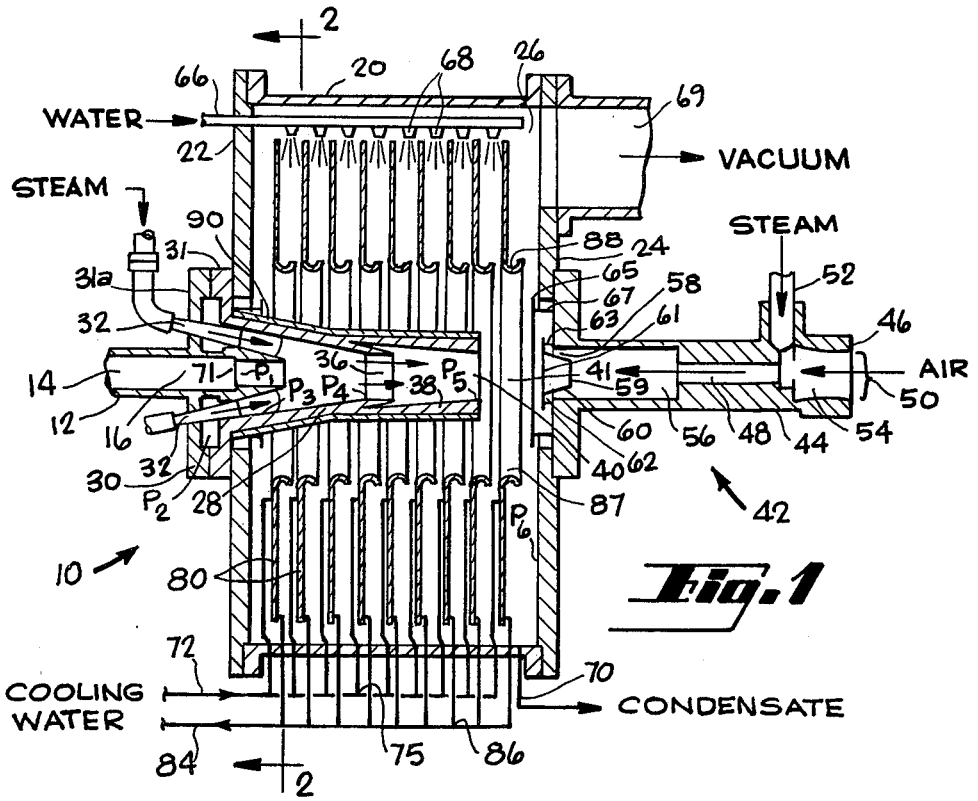
FIG. 1 is a schematic cross-sectional view of a steam ejector condenser unit which illustrates a preferred embodiment of the invention.
Figure 2:
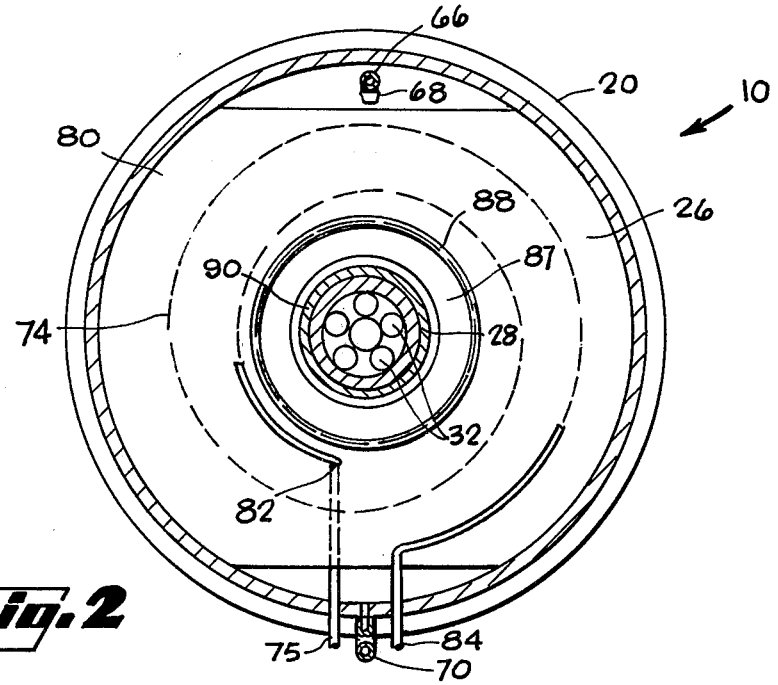
FIG. 2 is a schematic cross-sectional view section taken along the line 2—2 of FIG. 1.

Referring more particularly to the drawings, there is shown in FIGS. 1 and 2 a steam ejector condenser unit 10 which represents a preferred embodiment of the invention. The steam ejector condenser unit 10 comprises a generally cylindrical housing 20 having a first end wall 22 and a second end wall 24, which together therewith define a primary chamber 26. The end wall 22 is provided with a central opening through which a tubular ejector cone 28 extends into the primary chamber 26, generally coaxial therewith, and providing a flow path into the chamber. The ejector cone 28 is provided at its large end with an annular ejector base 30 located externally of the chamber 26. The ejector base 30 includes an external annular radial shoulder 31 disposed in engagement with the end wall 22, and affixed thereto by bolting or other suitable means.

Shown in FIG. 1 is tube 12 defining a tube port 14 which enters primary chamber 26 through the ejector cone and the opening defined by end wall 22. For certain applications, this tube 12 can be plugged if desired by suitable plugging means (not shown) at tube mouth 16 or elsewhere along the tube 12. Primary chamber 26 can be operated with tube 12 either open or closed, depending on the particular application of the invention. However, in either the tube-opened and tube-closed modes of operation, a vacuum pressure is applied by vacuum pumping means to keep primary chamber 26 at a negative pressure, while containing a small volume of air.

A plurality of steam nozzles 32, preferably symmetrically arranged around the tube 12, penetrate through the ejector base 30, and open toward ejector throat 36 defined by the funnel-shaped ejector cone 28. The nozzles extend through an annular flange 31*a* on tube 12, which seals against the radial shoulder 31. A funnel-shaped ejector diffuser 38 is attached to the outside of ejector cone 28 adjacent to the ejector throat 36. Ejector diffuser 38 tapers away from ejector throat 36 toward its narrow ejector diffuser mouth 40 at the small end thereof. However, ejector diffuser 38 could be straight or tapered the other way.

From steam nozzles 32, superheated steam exits and flows into ejector cone 28 at supersonic velocity. The steam moves toward ejector diffuser 38, and is compressed therein, exiting through ejector diffuser 38 and ejector diffuser mouth 40 into barrier space 41. While only two steam nozzles 32 are shown in FIG. 1, a typical arrangement might include five such steam nozzles mounted symmetrically in ejector cone 28 in a conical array, with the center being open, thus in one typical application accommodating passage of an accelerated electron beam or other particle beam.

Attached to the outside of primary chamber end wall 24 is a mixing chamber 42, having a generally cylindrical shape as defined by the cylindrical mixing chamber wall 44 and an end wall 46. The mixing chamber 42, at its other end, opens into the primary chamber 26 through an orifice 58 provided in the end wall 24 of the primary chamber 26. Mixing chamber 42 is also disposed in coaxial alignment with the ejector cone 28 and the ejector diffuser 38. The mixing chamber 42 includes a large diameter expansion cavity 56 at the end thereof which communicates with primary chamber 26. It also includes a smaller diameter intake cavity 48 which provides fluid connection between the expansion cavity 56 and an inlet chamber 54 which opens to the atmosphere. A superheated steam inlet nozzle 52 opens into the intake cavity 48, and supplies superheated steam to the intake cavity 48 when connected to a source of superheated steam.

In the inlet chamber 54, superheated steam and atmospheric air are mixed together in order to greatly reduce the volume of atmospheric air finally entering the primary chamber 26. This mixture travels through the intake cavity 48 into expansion cavity 56, where it expands just prior to entry into the chamber 26.

Coaxially mounted in orifice 58 is deflector 60 of generally conical shape and open at both ends, with the small end 59 facing into the expansion chamber 56 and the large end 61 facing into primary chamber 26. Deflector 60 is mounted on a plurality of mounting spacers 63, so that it is raised away from the inside surface of the primary chamber end wall 24 in such a manner that annular deflector channel 62 is defined by deflector 60 and the end wall 24, thereby permitting flow of the air/superheated steam mixture therethrough when superheated steam is supplied to the inlet chamber 54. Deflector channel 62 diverts a portion of the incoming air/superheated steam mixture in a direction generally parallel with the end walls of primary chamber 26. However, a small volume of this incoming mixture passes through orifice 58 and the deflector into barrier space 41 between the large end 61 of the deflector and the ejector, where it collides with the superheated steam exiting ejector diffuser mouth 40. An aerodynamic window is thereby created which, in cooperation with the vacuum pumps and cooling means, maintains ejector suction chamber 71, defined by tube 12 and ejector 28, at a negative pressure and without atmospheric air, while holding primary chamber 26 at a negative, but higher, pressure with the presence of a small amount of atmospheric air; simultaneously, primary chamber 26 is open through orifice 58 to atmospheric air.

Housed in primary chamber 26 is a cooling system comprising a water spray system and a water piping circulation system. Through a spray inlet pipe 66 which passes through the first end wall 22 near the top of the primary chamber 26, water is pumped through a plurality of spray nozzles 68 from which the water exits as a spray and rains down into primary chamber 26. This spray water cools the superheated steam so that some of the water vapor in the superheated steam condenses into liquid water, moves to the bottom of primary chamber 26, and exits through drain 70, penetrating the bottom of housing 20. This condensate water drains into a water collection system which is also maintained under a vacuum pressure.

An annular water shield 65 is attached with shield spacers 67 to second end wall 24, and protrudes inwardly therefrom into chamber 26. This water shield 65 is used to prevent water droplets from hitting the hot surfaces of the deflector 60.

The water piping circulation system can be seen partially in FIG. 1 and more fully in FIG. 2. Fixed at the bottom, and substantially traversing the length of chamber 26, are inlet manifold 72 and outlet manifold 84, approximately running parallel to each other. Attached to these two manifolds, and fixed to the inside surface of housing 20, are a plurality of water-cooled plates 80 aligned substantially, but not necessarily, at a 90° angle to the longitudinal axis of primary chamber 26. In one arrangement, mounted on the side of each plate 80 is a helically spiralling tubular coil 74, which is joined to inlet manifold 72 at coil inlet 75, penetrates plate 80 at penetration 82, emerges on the opposite side of plate 80, and, flat against the plate, uncoils from the center outward, connecting with an outlet manifold 84 at coil outlet 86. Alternatively, the coiling coils 74 could be placed inside plates 80, or could be affixed on the outside to the face of each side of plate 80. The coils 74 could be arranged circularly or horizontally. The manifolds also could be located at the top of primary chamber 26, and can be placed either inside or outside the primary chamber 26.

In the preferred embodiment, plates 80 are approximately parallel to one another. Each plate 80 defines at its center a plate opening 87, each of which is coaxially aligned with the other, as well as coaxially aligned with the axes of the ejector cone 28, diffuser 38, and mixing chamber 42. By water-pumping means, cooling water is pumped into primary chamber 26 through inlet manifold 72, the plurality of coils 74, the outlet manifold 84, and out through the manifold drain. Thus, the coils 74 are made cooler than the superheated steam in primary chamber 26, so that water vapor condenses out of the superheated steam onto the surfaces of coils 74 and plates 80, flows down to the bottom of primary chamber 26 and out through drain 70.

The water spray system and water piping circulation system described above produce water runoff inside primary chamber 26 which has the undesirable tendency of dripping down onto ejector cone 28 and ejector diffuser 38, where such water is instantly vaporized back into steam. To minimize the effects of this dripping and the recreation of steam, each plate 80, at the edge of its plate opening 87, is curled over to form lip 88, thus forming a channel along which runoff water which has condensed will flow down to the base of primary chamber 26, and out through drain 70. In addition, heat shield 90 is wrapped around and completely encloses the exterior of ejector cone 28 and ejector diffuser 38, so that water dripping down will not directly contact ejector cone 28 and ejector diffuser 38.

These two cooling systems, the vacuum pumps connected to primary chamber 26 through vacuum port 69, and the aerodynamic window cooperate to maintain ejector suction chamber 71 and primary chamber 26 at constant vacuums, while still permitting primary chamber 26 to be open to the atmosphere.

Example

Figure 3:
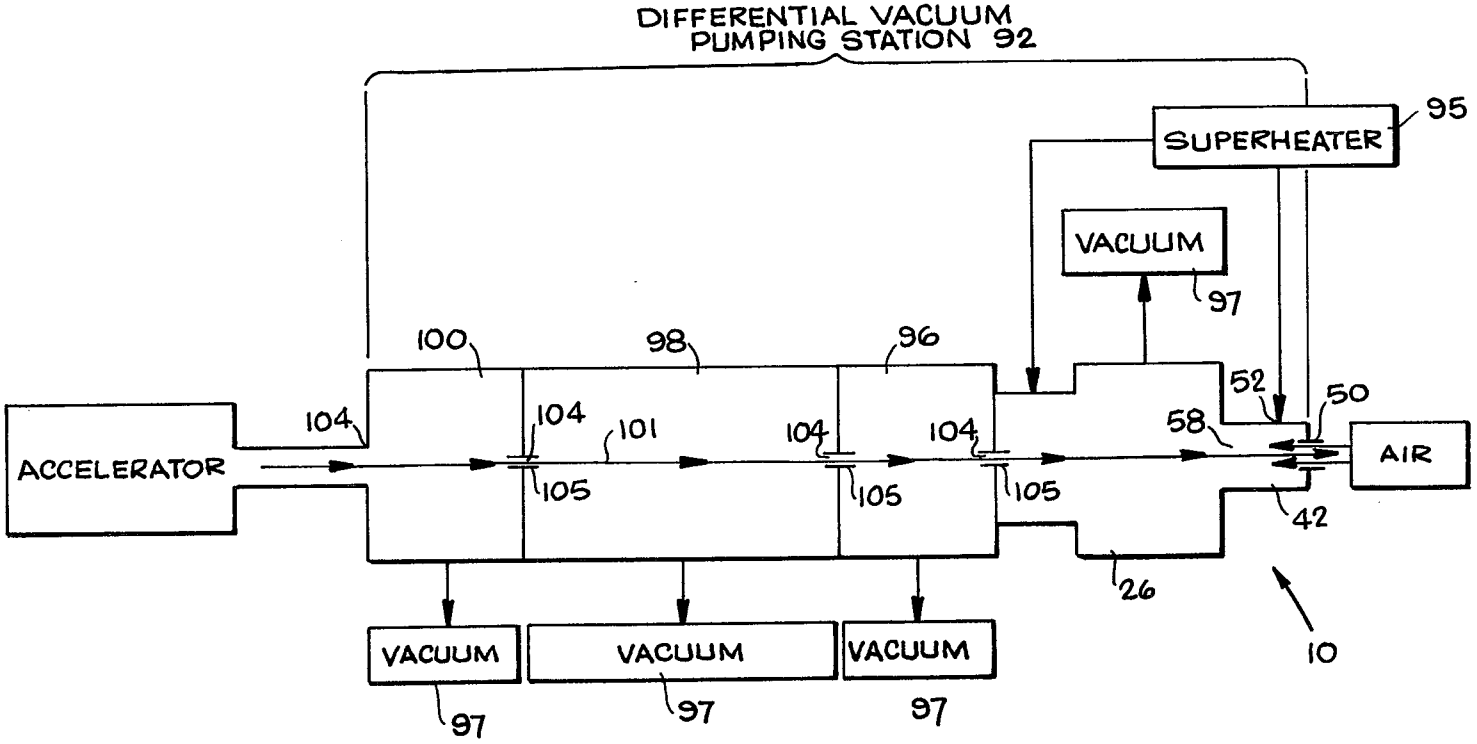
FIG. 3 is a block diagram schematic arrangement of an example application of the invention, in which the invention is incorporated as one stage of a differential vacuum pumping system used in conjunction with an electron beam accelerator.

The steam ejector condenser unit 10, shown schematically in FIG. 1, has been built and tested. Although it has other applications, it was specifically built in this example for use as the first stage in a differential vacuum pumping station 92, shown in partial schematic in FIG. 3. This pumping station has four stages, consisting of: (1) a first stage, which is the steam ejector condenser unit 10 shown in FIGS. 1 and 2, including the air, the superheater 95 which is the source of superheated steam, and mechanical vacuum pumps 97; (2) a second stage 96, plus vacuum pumps 97 representing a freon-cooled trap, roots blowers, and mechanical vacuum pumps; (3) a third stage 98, liquid nitrogen traps, oil diffusion pumps, roots blowers, and mechanical vacuum pumps 97; and (4) a fourth stage 100 and cryo-vacuum pumps 97. The plurality of vacuum pumps 97 represent all combinations of the various standard pumping means and traps discussed above.

Accelerator 102, which produces and accelerates an electron beam 101, and which operates at high vacuum pressure, is connected to the differential vacuum pumping station 92, the latter providing an unobstructed passage through a plurality of opening members 104 from a high vacuum ($5\times10^{-6}$ torr) in Stage 100 to the atmosphere along the system axis. In this example, the accelerator electron beam 101 is focussed along the system axis through a series of 2 cm (0.79 inches) diameter opening members 104 which define a passage to tube 12 which, in this example, is unobstructed, and passes to the atmosphere through orifice 58 and aperture 50, without foil windows or other solid material for keeping out the atmospheric air.

As mentioned, attached to each stage are vacuum pumps, shown here as a plurality of vacuum pumps 97 or other source of vacuum pressure, to remove the gas load (in this case, air) from the adjacent higher pressure region. The steam ejector condenser unit first stage 10 produces a 10-torr vacuum in the ejector suction chamber 71, and a 60-torr vacuum in primary chamber 26, whether the 2 cm diameter aperture 50 was open or closed to the atmosphere. It is usually desirable, during start-up of the system, to close aperture 50 as by a valve means (not shown).

The steam ejector condenser unit 10 was built into the path of the electron beam 101, to provide a barrier between the atmospheric air and the water vapor vacuum atmosphere in stages 96, 98, and 100. This feature permits high volume cryotrapping of water vapor in the three lower pressure stages 96, 98, and 100. Except for the regeneration of cold traps and cryo-vacuum pumps, the differential vacuum pumping station 92 is a steady state operating unit. After the differential vacuum pumping station 92 is started, the electron beam 101 will pass from the high vacuum region of accelerator 92 through progressively lesser vacuums, finally exiting through aperture 50 to atmospheric pressure without any physical barrier.

In this example, the quantity of air that would flow through an unrestricted 2 cm diameter aperture 50 from atmospheric pressure to the vacuum in primary chamber 26 is $6.2\times10^{-2}$ $m^3/s$ (130 SCFM). This presents a sizeable vacuum pumping requirement, as a condenser pressure of 72 torr or less is necessary to keep the steam ejector components operating reliably. Superheated steam injected at the 2 cm superheated steam inlet 52 on the atmosphere side reduces the net air flow entering primary chamber 26 through orifice 58 to 1/10 of the unrestricted rate, from $6.2\times10^{-2}$ $m^3/s$ (130 SCFM) down to $7.1\times10^{-3}$ $m^3/s$ (10 SCFM).

The superheated steam is supplied by a steam boiler sized to deliver 272 kg/hr (600 lbs/hr) of steam at 207 kPa (30 psig) to superheater 95. Under normal operating conditions, approximately 181.6 kg/hr (400 lbs/hr) of 250° C. superheated steam was delivered to the mixing chamber 42, of which 68.1 kg/hr (150 lbs/hr) was supplied to the ejector nozzle 28.

Because the vapor pressure of water is approximately 25 torr at normal cooling temperatures, a vacuum is produced when the superheated steam is condensed into water; the air is simultaneously removed from primary chamber 26 by vacuum pump 97. Primary chamber 26 pressure is also dependent upon the amount of steam that is produced in the center section of primary chamber 26 by water droplets hitting the hot exterior surfaces (250° C.) of the ejector cone 28 and ejector diffuser 38. To prevent this, heat shield 90 is mounted around these hot surfaces to maintain a low pressure at the center of the primary chamber 26 and ejector suction chamber 71. Because the air/steam mixture entering into the primary chamber 26 must exit radially and outward between the cooling plates 80, a large vacuum conductance between the plates 80 is required for passage of the large volume of air and steam. Otherwise, choking will occur, and the steam ejector condenser unit 10 will not function because of the high back pressure at ejector diffuser mouth 40. As the steam ejector condenser unit 10 is also very sensitive to the velocity-pressure effect of the incoming air/steam gas going into primary chamber 26 through orifice 58, the deflector 60 is necessary to divert a large portion of the incoming air/steam gas away from the exhaust gases emerging out of the ejector diffuser mouth 40 and into the barrier space 41.

To cool the air and condense the superheated steam, the primary chamber 26 is oufitted with 6.5 $m^2$ (70 $ft^2$) of water-cooled surfaces, comprising a plurality of water-cooled coils 74 attached to a plurality of plates 80 and a direct cooling spray system emitting a mist of water through a plurality of spray nozzles 68. In this example, approximately $3.8\times10^{-3}$ $m^3/s$ (60 gals/min) of water circulates through a plurality of coils 74 mounted on nine vertical, copper plates 80, to provide the indirect cooling surfaces. The condensed water exits through drain 70 into a vacuum-tight collection vessel (not shown).

Approximately 200 kw of energy is removed by the cooling system in primary chamber 26, which in this example is a cylinder 50 cm (23") in diameter by 31 cm (12") long.

In this example, five steam nozzles 32 were mounted symmetrically around the axis of ejector cone 28 in a conical array, with the center of ejector cone 28 open for the passage of the accelerator electron beam. Ejector cone 28 exhausts its steam toward the orifice 58, to minimize the volume of air entering through orifice 58 and moving through opening 104 which is connected to tube 12.

Designed to use 68.1 kg/hr (150 lbs/hr) of superheated steam at 250° C., the ejector cone 28 will produce a vacuum of 10 torr in the ejector suction chamber 71, while keeping out the atmospheric air. The steam entering through steam nozzles 32 is superheated to minimize the formation of liquid water droplets as the steam vapor expands in the steam nozzles 32.

The ejector cone 28 is fabricated from type 304 stainless steel. The vacuum flanges are a standard knife-edge design, with copper gaskets, and suitable for high temperature use (500° C.). The ejector nozzle 28 and steam nozzle 32 specifications are as follows:

| | |
|---|---|
| Number of steam nozzles 32 used | 5 |
| Steam nozzle 32 throat diameter | 0.79cm (0.31") |
| Steam nozzle 32 throat area (total) | 3.45cm$^2$ (0.38"$^2$) |
| Steam nozzle 32 exit area (total) | 13.29cm$^2$ (2.08"$^2$) |
| Steam nozzle 32½ angle | 5° |
| Ejector cone 28 throat diameter | 4.14cm (1.63") |
| Ejector cone 28½ angle | 10° |

The steam ejector condenser system of first stage 10 is relatively simple to start and operate. After closing aperture 50 to the atmosphere with a suitable standard valve means, vacuum pumps 97 and superheater 95 are activated. When the superheated steam supplied to the steam nozzles 32 reaches 250° C. at a pressure of 400 torr, a vacuum of 10 torr is established in the ejector suction chamber 71, and aperture 50 can be opened. First stage 10 is now ready for steady state operation.

The plurality of vacuum pumping systems indicated by vacuum pumps 97 for the differential vacuum pumping station 92 have been designed to take advantage of the high volume pumping speeds that are possible when a vacuum atmosphere is essentially 100% water vapor. For a 2 cm diameter connection tube 105 to third stage 98, two cryo-vacuum pumps 12" inside diameter) will maintain a $5\times10^{-7}$ torr vacuum in fourth stage 100 if the vacuum atmosphere is 100% water vapor. However, if the atmosphere were changed to air, three cryo-vacuum pumps instead of two would be required to maintain the same vacuum pressure in the fourth stage 100. The primary reason for this difference is that, while the conductance through an aperture for water vapor is twice that for air, the pumping speed is three times as fast. A similar argument can be made for maintaining a 100% water vapor atmosphere in the third stage 96 and fourth stage 98.

In first stage 10, superheated steam entering inlet 52 is used to displace a large portion of the air coming in through aperture 50. This reduces the mechanical vacuum pumping requirements by 90%. A vacuum is produced by condensing the steam in primary chamber 26 and using the vacuum pumps 97 to remove the air.

Each stage of the differential vacuum pumping station 92 is connected by 2 cm inside diameter×15 cm long tube 105 through which the accelerator electron beam passes. The vacuum conductance of the tube 105 is low to reduce the gas load to each vacuum 97. The vacuum components in the second, third, and fourth stages are preferably cold traps and cryo-pumps to remove the water vapor. Two-stage mechanical vacuum pumps 97 and standard diffusion pumps and roots blowers, if necessary, can be used to remove residual noncondensible gases and maintain a differential pressure across the cold traps.

Figure 4:
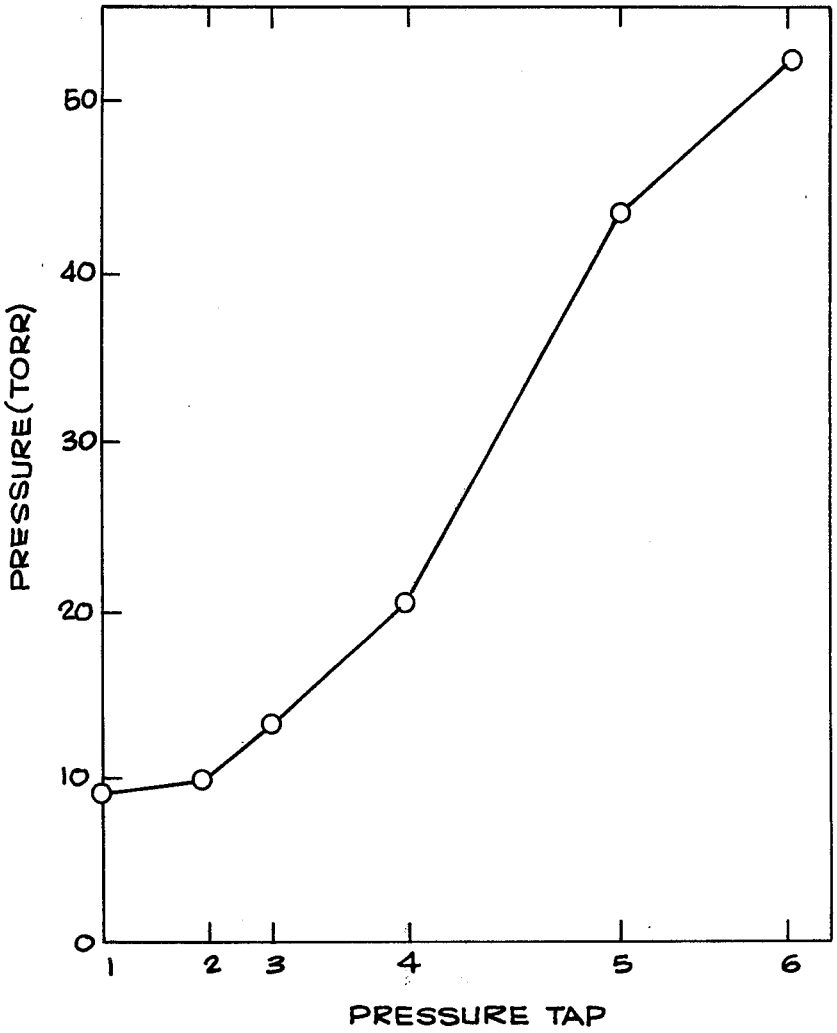
FIG. 4 is a graph showing pressure level data obtained from pressure taps placed inside the primary chamber of the invention at points $P_1$ through $P_6$ as shown in FIG. 1.

The steam ejector condenser unit 10 test results are shown in FIG. 4. Pressure taps $P_1$ through $P_6$ shown in FIG. 4 correspond to the points in FIG. 1 where those pressure readings were taken. With a 2 cm diameter aperture 50 to the atmosphere and first stage 10 operating in a steady state mode, the vacuum in ejector suction chamber 71 held at a constant 10 torr while the pressure elsewhere inside primary chamber 26 was 60 torr.

In the foregoing description and example, a preferred embodiment of the invention has been presented for purposes of illustration and description, and is not intended to be exhaustive or to limit the invention to the precise form disclosed. It was chosen and described in order to best explain the principles of the invention and their practical application to thereby enable others skilled in the art to best utilize the invention in various embodiments and with various modifications as are suited to the particular use contemplated. It is intended that the scope of the invention be defined by the claims appended hereto.

I claim:

1. Apparatus for creating and maintaining a vacuum in a primary chamber which has an opening to the atmosphere or other region of higher gas pressure, by formation of an aerodynamic window before said opening, said apparatus comprising:

wall means defining said primary chamber, said primary chamber adapted to be coupled to a source of vacuum pressure, and having a wall thereof provided with an orifice which communicates with the atmosphere or said region of higher gas pressure;

ejector means connectable to a source of superheated steam for ejecting superheated steam into said primary chamber in the direction toward said orifice;

mixing chamber means for mixing superheated steam with gas from the atmosphere, said mixing chamber means being coupled in fluid communication with said orifice, and having an aperture communicating with the atmosphere or said region of higher gas pressure;

nozzle means for injecting superheated steam into said mixing chamber means, said nozzle means being connectable to a source of superheated steam;

cooling means mounted to the inside of said primary chamber for effecting the condensation of superheated steam introduced into said primary chamber from said ejector means and said mixing means, said condensation thereby enhancing the vacuum condition of said primary chamber; and drain means connectable to said primary chamber for removing the condensate from said primary chamber without disturbing the vacuum condition of said primary chamber, whereby superheated steam is introduceable into the primary chamber from said ejector means to collide with the mixture of atmospheric gas and superheated steam injected into the primary chamber from said mixing chamber means to form an aerodynamic window in front of said primary chamber orifice which restricts the flow of gas into said primary chamber from the atmosphere or other region of higher gas pressure.

2. The apparatus as described in claim 1, further including deflector means located between said ejector means and said orifice, and defining a passage coaxially aligned with said ejector means and said orifice, for deflecting a portion of said atmospheric gas and superheated steam mixture outwardly toward the walls defining said primary chamber when the mixture is introduced to the primary chamber from said mixing chamber means;

and also directing a portion of said mixture through said deflector passage toward said ejector means, to thereby collide with superheated steam ejected from said ejector means to form said aerodynamic window.

3. The apparatus as described in claim 1, wherein said cooling means comprises a coolant spray system affixed within said primary chamber, and operable to spray a coolant medium over the contents of said primary chamber.

4. The apparatus as described in claim 1, wherein said cooling means includes a coolant circulating system connectable to a source of coolant medium, and comprising a plurality of heat-exchanger surfaces in heat-exchanging relationship with said coolant medium, and with superheated steam introduced into said primary chamber.

5. The apparatus as described in claim 4, wherein said heat-exchanger surfaces are in the form of a plurality of plates mounted in spaced relation on said primary chamber wall means to extend inwardly into said primary chamber.

6. The apparatus as described in claim 1, wherein said cooling means comprises a coolant spray system which is operable to spray a coolant medium over the contents of said primary chamber, and a coolant circulating system comprising a plurality of heat-exchanger surfaces in heat-exchanging relationship with said coolant medium, and with the superheated steam introduced into said primary chamber.

7. The apparatus as described in claim 1, wherein said ejector means is provided with a tube extending through said ejector means and forming a tubular opening into said primary chamber, with said tubular opening being disposed in alignment with said aerodynamic window, said primary chamber orifice and said aperture in the mixing chamber means which communicates with the atmosphere or other region of higher gas pressure, whereby said apparatus is rendered suitable for the passage of a particle beam through said tubular opening into said primary chamber, and through the aerodynamic window into the atmosphere or other region of higher gas pressure.

8. The apparatus as described in claim 7, wherein said ejector means is provided with an ejector diffuser mouth, and further comprises a plurality of nozzles disposed in symmetric array around the tubular opening through the ejector means, and oriented to direct the ejected steam from said plurality of nozzles toward said ejector diffuser mouth.

9. The apparatus as described in claim 8, further including deflector means located between said ejector means and said orifice, and defining a passage coaxially aligned with said ejector means and said orifice for deflecting a portion of said atmospheric gas and superheated steam mixture outwardly toward the walls defining said primary chamber, where the mixture is introduced to the primary chamber from said mixing chamber means; and also directing a portion of said mixture through said deflector passage toward side ejector means, to thereby collide with superheated steam ejected from said ejector means to form said aerodynamic window.

10. The apparatus as described in claim 9, wherein said primary chamber is adapted to be coupled through said tubular opening to the differential vacuum pumping station of a particle beam accelerator and in alignment therewith to permit the passage of the accelerator particle beam to the atmosphere.

* * * * *